US010960657B2

(12) United States Patent
Kapp

(10) Patent No.: US 10,960,657 B2
(45) Date of Patent: Mar. 30, 2021

(54) PRINTER DRYER MONITOR

(71) Applicant: Hewlett-Packard Development Company, L.P., Spring, TX (US)

(72) Inventor: Tyler Kapp, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 252 days.

(21) Appl. No.: 16/330,846

(22) PCT Filed: Sep. 8, 2016

(86) PCT No.: PCT/US2016/050723

§ 371 (c)(1),
(2) Date: Mar. 6, 2019

(87) PCT Pub. No.: WO2018/048403

PCT Pub. Date: Mar. 15, 2018

(65) Prior Publication Data

US 2019/0210357 A1 Jul. 11, 2019

(51) Int. Cl.

| | |
|---|---|
| ***B41J 29/28*** | (2006.01) |
| ***B41F 23/04*** | (2006.01) |
| ***F26B 21/10*** | (2006.01) |
| ***B41J 11/00*** | (2006.01) |
| ***F26B 21/12*** | (2006.01) |
| ***B41J 29/38*** | (2006.01) |

(52) U.S. Cl.

CPC ..... *B41F 23/04* (2013.01); *B41F 23/0466* (2013.01); *B41J 11/002* (2013.01); *B41J 29/38* (2013.01); *F26B 21/10* (2013.01); *F26B 21/12* (2013.01)

(58) Field of Classification Search

CPC ..... B41J 11/002; B41J 29/38; F04D 25/0613; B41F 23/04; B41F 23/0466; F26B 21/10

See application file for complete search history.

(56) References Cited

U.S. PATENT DOCUMENTS

| | | | |
|---|---|---|---|
| 5,727,928 | A | 3/1998 | Brown |
| 6,040,668 | A | 3/2000 | Huynh et al. |
| 6,283,590 | B1 | 9/2001 | Peter |
| 6,920,704 | B1 | 7/2005 | Silverbrook et al. |

(Continued)

FOREIGN PATENT DOCUMENTS

| | | |
|---|---|---|
| RU | 2574386 C1 | 2/2016 |
| WO | WO-2014046665 | 3/2014 |

OTHER PUBLICATIONS

Numata. et al., Drying Technology Using Laser Exposure for High-speed Inkjet Printing, 2013, http://www.ingentaconnect.com/ ~ 2 pages.

*Primary Examiner* — Alesa Allgood
(74) *Attorney, Agent, or Firm* — HP Inc. Patent Department

(57) ABSTRACT

A circuit includes a pulse generator to generate an output pulse in response to a signal representing rotation of a fan. A timing relationship between output pulses represents speed of the fan. A filter circuit converts the output pulse to a direct current (DC) voltage signal proportional to the speed of the fan. A monitor circuit monitors the DC voltage signal with respect to a predetermined threshold and generates a control signal that disables a printer dryer if the DC signal does not satisfy the predetermined threshold.

15 Claims, 6 Drawing Sheets

(56) References Cited

U.S. PATENT DOCUMENTS

| | | | | |
|---|---|---|---|---|
| 7,425,063 | B2 | 9/2008 | Silverbrook et al. | |
| 7,479,753 | B1 | 1/2009 | Mimberg | |
| 9,283,772 | B2 | 3/2016 | Perez Gellida | |
| 2006/0214970 | A1* | 9/2006 | Hirakawa | C09D 11/54 347/15 |
| 2009/0244236 | A1* | 10/2009 | Houjou | B41J 11/002 347/102 |
| 2018/0370229 | A1* | 12/2018 | Takeuchi | B41J 11/002 |

* cited by examiner

PRINTER DRYER MONITOR

BACKGROUND

In some printing applications, dryers are employed to speed up the overall printing process. This can be implemented by supplying heat to rapidly dry dispensed ink on a given substrate, such as paper or other media. For example, some printing applications may utilize higher power dryers to dry the ink after it is dispensed. Since the dryers can operate at higher power, safety systems can be provided to help ensure that the dryer is operating within expected operating parameters.

DETAILED DESCRIPTION

This disclosure relates to a circuit that monitors fan speed signals and/or temperature signals of a printer with respect to one or more predetermined thresholds and to control a printer dryer based on satisfying the threshold(s). In one example, a circuit includes a pulse generator to generate an output pulse in response to a signal representing rotation of a fan. This rotation signal can be a received from an encoder coupled to the shaft of the fan, for example. A timing relationship between output pulses represents speed of the fan. In one example, the output pulse can have a duty cycle having a fixed on time parameter where the off time parameter of the output pulse varies according to the speed of the fan. A filter circuit (e.g., resistor/capacitor (RC) filter) converts the output pulse to a direct current (DC) voltage signal proportional to the speed of the fan. A monitor circuit monitors the DC voltage signal with respect to a predetermined threshold and generates a control signal that disables a printer dryer if the DC signal does not satisfy the predetermined threshold. A temperature circuit can also be provided to monitor temperature (e.g., within the printer housing) with respect to a predetermined threshold and to generate a temperature control signal if the temperature satisfies the predetermined threshold. The fan speed control signal and the temperature control signal can be gated to generate a combined control signal to disable the dryer if each of the predetermined thresholds is not satisfied. Thus, if either of the thresholds is not satisfied, however, the circuit can employ a safety interlock to shut down the dryer in the absence of processor intervention.

By monitoring fan speed and/or temperature as a standalone circuit outside of processor interaction, various improvements can be achieved over conventional dryer control schemes. Conventional circuits utilize expensive frequency to voltage converter integrated circuits that had to have their outputs digitized, read by an analog to digital converter (ADC), and processed by a processor to determine fan speed. The circuits in this disclosure provide pulse generation and filtering techniques that mitigate the need for expensive frequency conversion and ADC circuits. Moreover, the circuits disclosed herein provide an additional layer of redundancy for failure detection. If a processor were to fail in conventional circuits, printer fan speeds and/or dryer temperatures could remain unchecked and uncontrolled due to the processor failure. The stand-alone circuits described herein can monitor fan speed/temperature and disable the dryer outside of processor interaction. This provides additional monitoring and control of the dryer over conventional circuits regardless of the state of the processor.

Figure 1:
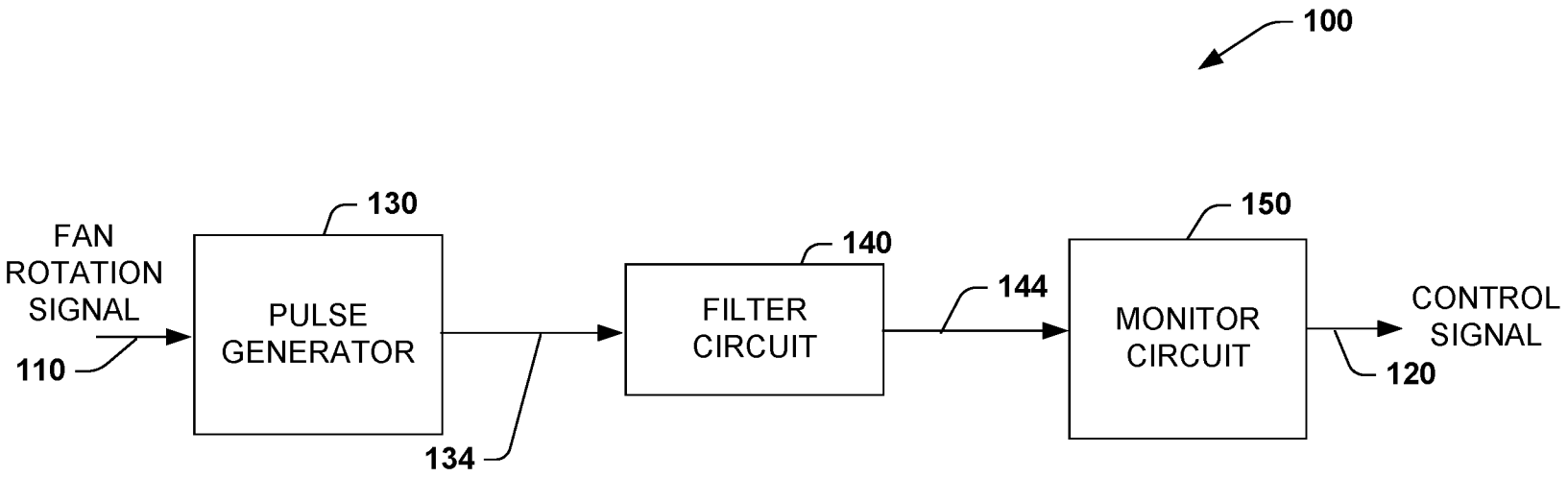
FIG. 1 is a block diagram illustrating an example of a circuit to monitor a fan rotation signal.

FIG. 1 illustrates an example block diagram of a circuit 100 to monitor a fan rotation signal 110 and to generate a control signal 120 to a printer dryer based on the rotation signal. As used herein, the term circuit can include a collection of active and/or passive elements that perform a circuit function, such as an analog circuit, digital circuit or a combination thereof, such as to provide a control circuit, for example. Additionally or alternatively, the term circuit can include an integrated circuit where all and/or some of the circuit elements are fabricated on a common substrate, for example.

As shown in the example of FIG. 1, the circuit 100 includes a pulse generator 130 to generate an output pulse 134 in response to the signal 110 representing rotation of a fan (not shown). A timing relationship between output pulses 134 represents speed of the fan. A filter circuit 140 converts the output pulse 134 to a direct current (DC) voltage signal 144 proportional to the speed of the fan. A monitor circuit 150 monitors the DC voltage signal 144 with respect to a predetermined threshold and generates the control signal 120 that disables a printer dryer (not shown) if the DC signal does not satisfy the predetermined threshold.

As an example, a one-kilowatt (kW) power dryer (or other power range) can be provided with the respective printer, which includes the use of interlock circuitry, such as described herein, to mitigate unsafe operation. These circuits provide a low-cost, standalone solution for monitoring both fan speed and temperature and preventing energizing of the heating elements of the dryer should either or both of these inputs be outside of a predetermined range. Due to the circuit's ability to operate standalone, it can provide a backup in the event that a firmware failure should occur. Prior solutions included dedicated frequency to voltage conversion circuits for determination of fan speed. However, this solution has the disadvantage of being significantly more expensive. Other solutions involved the use of firmware to monitor both fan speed and temperature directly. However, this has the disadvantage of a single point of failure being able to cause a safety concern.

The circuit 100 provides a safety interlock function for the dryer by monitoring fan speed as well as dryer temperature and preventing firmware from energizing heating element(s) if either input is outside of a predetermined range. The circuit 100 operates standalone therefore allowing it to function as a redundant backup to firmware controlled interlocks. Outputs from the circuit fan and temperature circuits described herein enable firmware to monitor the state of the interlock and determine if either or both inputs are determined to be out of range.

The signal 144 representing rotation speed of the fan can be an encoder signal representing rotation of the fan, for example, however other types of devices are possible such as a resolver that is coupled to the shaft of the fan. The output pulse 134 can have a duty cycle that represents the speed of the fan. For instance, the output pulse 134 can have a fixed on time parameter that is triggered via a rising or falling edge of the signal 110 representing rotation of the fan and a variable off time parameter that varies with the speed of the fan. In other example implementations, the off time parameter could be fixed and the on time parameter varied with the speed of the fan.

Figure 5:
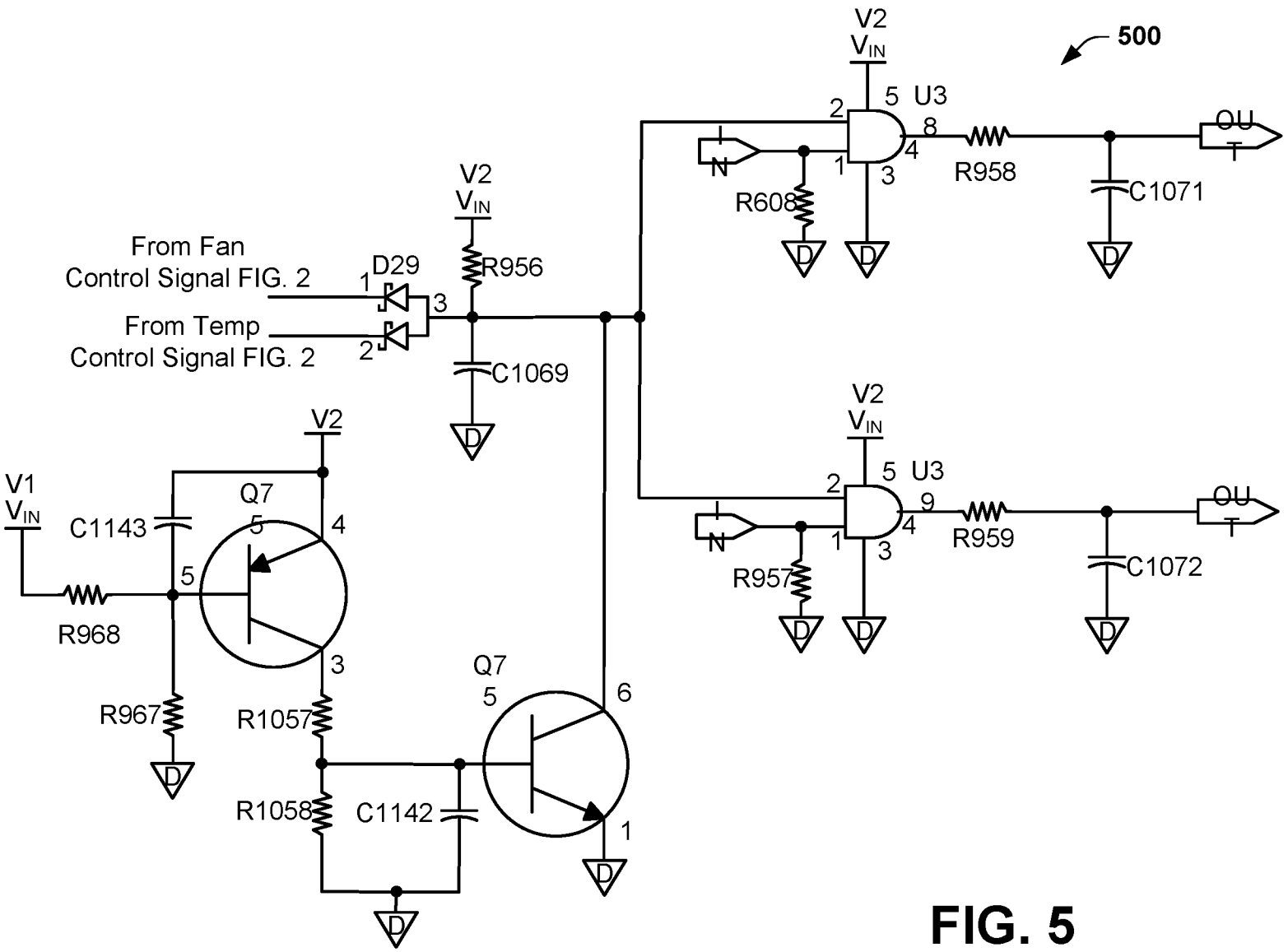
FIG. 5 is a circuit diagram illustrating an example of a gating circuit to generate a combined control signal to control a printer dryer.

Temperature in the printer dryer can be controlled by enabling/disabling triacs to apply alternating current (AC) to or remove AC from the heating elements in the dryer which can in turn be controlled by the control signals described herein (see e.g., control signals at D29 pins 1 and 2 of FIG. 5). The logic/control signals that perform these functions can be gated (e.g., only enabled to be passed to the triacs in the event the fan speed is above a minimum threshold level and the dryer temperature within a valid temperature range). Print media (e.g., paper) in the printer can be physically separated from the heating elements in the dryer and the fan is utilized to blow heated air across the page to be printed as it passes through a given portion of the paper path. Fan speed can be determined based upon density of the print and may not be used to regulate temperature in the dryer. In other example applications, fan speed can be utilized to regulate temperature of the dryer. However, having a minimum fan speed provides several advantages. The fan speed enables airflow across a thermistor (or other temperature sensor) to ensure accurate readings are being made of the temperature in the dryer. Also, the fan speed serves to mitigate degradation of the thermal fuses in the dryer due to normal operation that could lead to early life failures. Such fuses can be provided to open in the event of a failure, (e.g., powering of the heating elements without the fan running).

Figure 3:
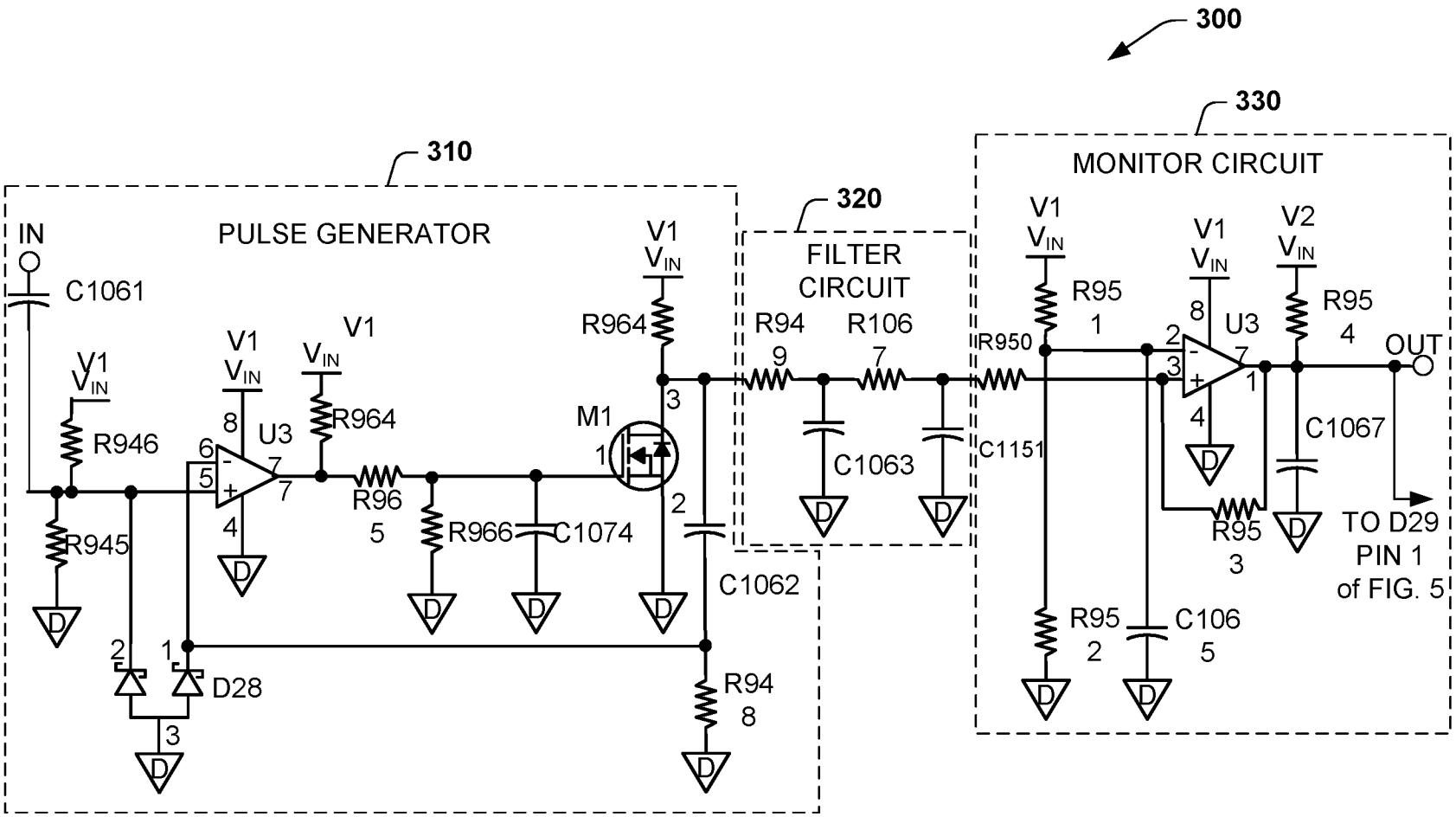
FIG. 3 is a circuit diagram illustrating an example of a circuit to monitor a fan rotation signal.

As disclosed herein, such as with respect to FIG. 3, the pulse generator 130 can include a comparator to compare the signal 110 representing rotation of the fan with a predetermined signal threshold and to generate an output based on the comparison. The output from the comparator can trigger a monostable circuit, for example, to generate a single pulse having a fixed on time and a variable off time representing the speed of the fan. The filter circuit 140 can be any type of filter to convert the output pulse 134 into a DC value. In one specific example, a resistor/capacitor (RC) filter can be employed in the filter circuit 140.

Figure 2:
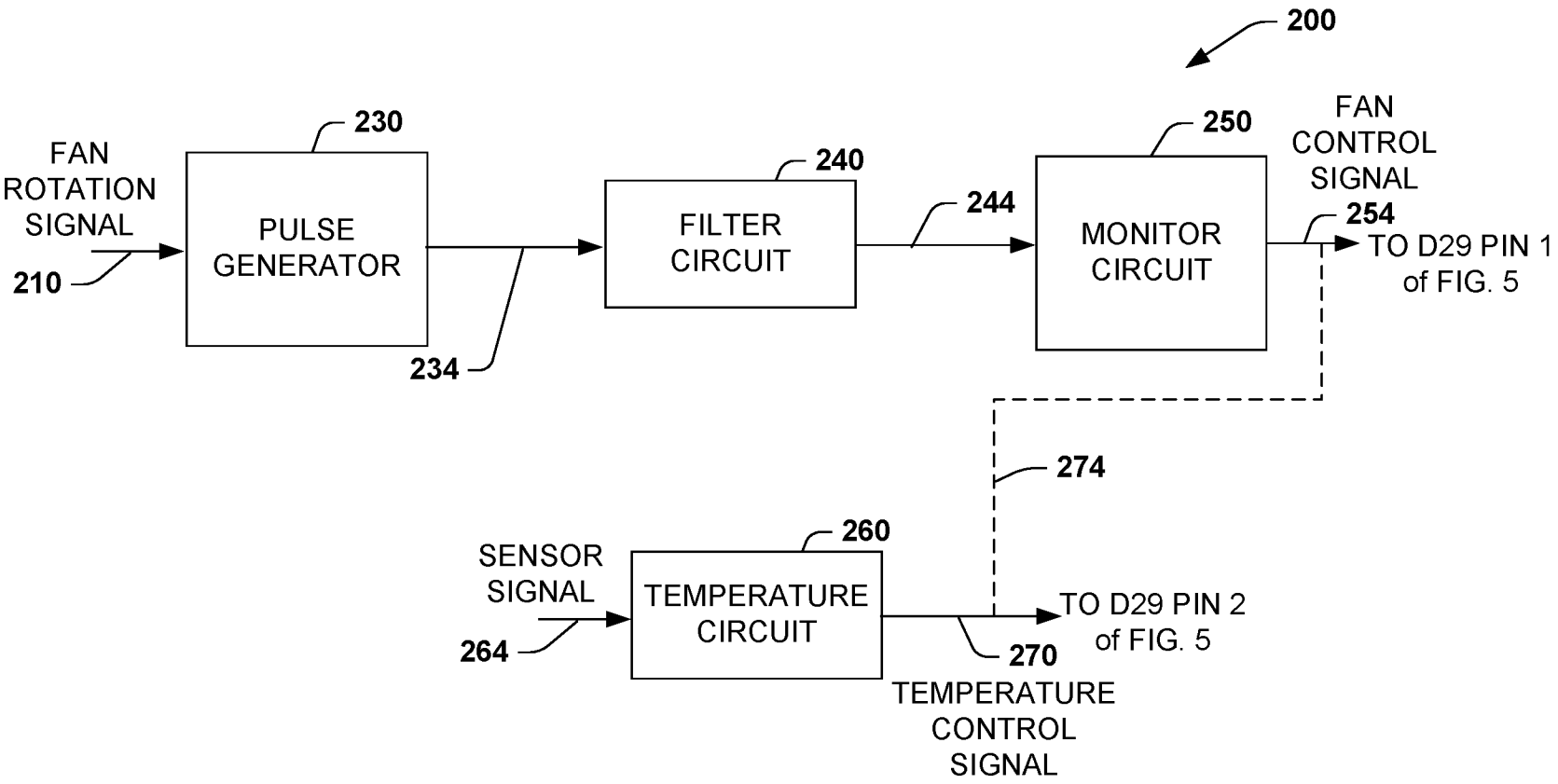
FIG. 2 is a block diagram illustrating an example of a circuit to monitor a fan rotation signal and temperature.
Figure 4:
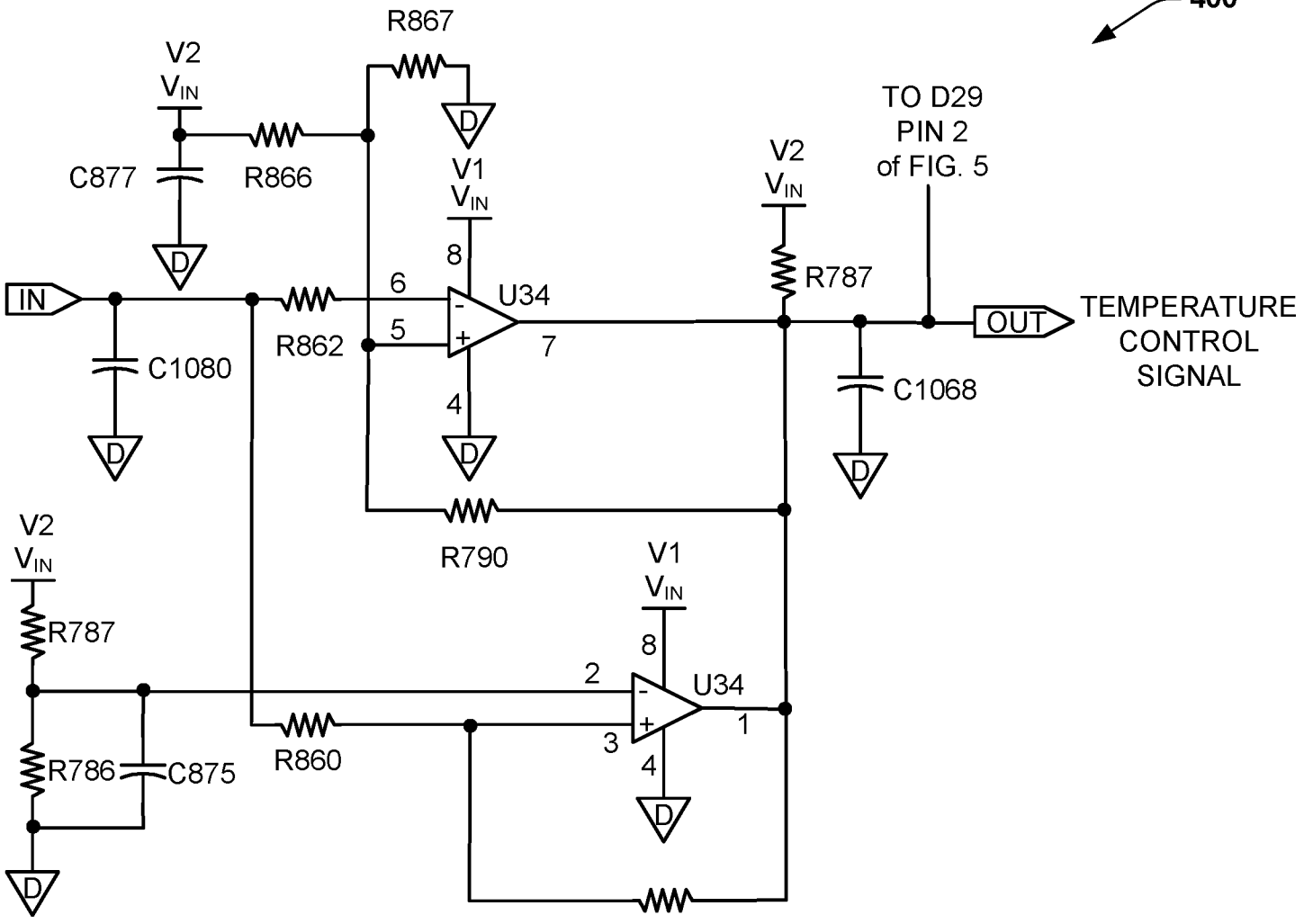
FIG. 4 is an example circuit diagram illustrating a temperature circuit to monitor temperature and to generate a temperature control signal for a printer dryer.

The monitor circuit 150 can also include a comparator to monitor the DC voltage signal 144 proportional to fan speed with respect to the predetermined threshold. In addition to fan speed monitoring, temperature monitoring can also be provided such as illustrated in FIGS. 2 and 4 described below. This can include a temperature circuit to monitor temperature with respect to a predetermined threshold and to generate a temperature control signal if the temperature satisfies the predetermined threshold. The fan speed control signal and the temperature control signal can be gated to generate a combined control signal to disable the dryer if the predetermined thresholds are not satisfied. Additionally, a DC monitor circuit (see e.g., FIG. 5) can be provided to disable the combined control signal if a power supply input rail to the comparator does not satisfy a predetermined supply threshold.

FIG. 2 illustrates an example of a circuit 200 to monitor a fan rotation signal 210 and temperature and to generate a combined control signal to a printer dryer. Similar to the circuit 100 described above, the circuit 200 includes a pulse generator 230 to generate an output pulse 234 in response to the signal 210 representing rotation of a fan (not shown). A timing relationship between output pulses 234 represents speed of the fan. A filter circuit 240 converts the output pulse 234 to a direct current (DC) voltage signal 244 proportional to the speed of the fan. A monitor circuit 250 monitors the DC voltage signal 244 with respect to a predetermined threshold and generates a fan control signal 254 that disables a printer dryer (not shown) if the DC signal does not satisfy the predetermined threshold.

The circuit 200 includes a temperature circuit 260 to monitor temperature from a sensor signal 264 with respect to a predetermined temperature threshold and generates a temperature control signal 270 if the temperature satisfies the predetermined threshold. The fan control signal 254 and the temperature control signal 270 can be supplied in tandem to a gating circuit shown at reference numeral 274 and can be gated (e.g., via a logic gate) to generate a combined control signal to disable the dryer if each of the predetermined thresholds is not satisfied. The gating circuitry is depicted in FIG. 5 where the signal 254 is routed to pin 1 of gate D29 and signal 270 is routed to pin 2 of gate D29 of FIG. 5. The temperature circuit 260 can include a window comparator that monitors for both a maximum and minimum temperature for operation of the printer dryer. If the sensor signal 264 (e.g., thermistor signal) is below a predetermined low temperature threshold or above a predetermined high temperature threshold set by the window comparator, the temperature control signal 270 can be set to disable the dryer, for example, via temperature control signal 270. An example circuit implementation for the circuit of FIG. 1 is shown in FIG. 3. An example circuit implementation for the temperature circuit 260 is shown in FIG. 4. An example circuit implementation for the gating circuit described herein is shown in FIG. 5.

FIG. 3 illustrates an example of a circuit 300 to monitor a fan rotation signal and to generate a control signal to a printer dryer based on the rotation signal. The fan rotation signal is received at an input (IN) of a pulse generator 310 which drives a filter circuit 320 which is in turn monitored by monitor circuit 330 to generate a control output signal shown as (OUT). The circuit 300 includes the pulse generator 310 to convert the fan rotation signal to a series of pulses, which is then filtered to a DC value via the filter circuit 320 and compared to a reference voltage via U37 pin 2 corresponding to a revolutions per minute (RPM) level above which the dryer is allowed to operate. A dual comparator integrated circuit U37 can be utilized to perform both functions of pulse generation and monitoring as described herein.

The fan rotation signal at IN can be coupled via capacitor 1061 and received via pin 5 of U37 to provide sufficiently fast edges and this signal AC coupled to the non-inverting input of the comparator U37. In some examples, buffering may be provided to the fan signal before it is received at the input IN. A reference threshold is set via R945 and R946 (e.g., magnitude of the falling edge of the fan rotation signal) where diodes of integrated circuit D28 provide input clamping to a minimum negative threshold for U37. The output of the comparator U37 pin 7 is inverted by the common-source amplifier formed by M1 and R964 and fed back to the inverting input pin 6 of U37 through an RC network comprised of C1062 and R948. The transistor M1 is driven via RC network of resistors R964, R965, R966, and capacitor C1074. Output duty cycle pulse control is provided via C1062 and R948. R964 provides a pull-up for the open drain output of U37. The resistors R945 and R946 can be sized such that their Thevenin equivalent resistance is approximately that of R948 to mitigate the impact of input bias current.

The output from pin 3 of M1, which functions as a common source amplifier in monostable multivibrator (e.g., the pulse generator circuit depicted in 310), is a pulse with fixed on time and varying duty cycle. On time can be set using the RC network referenced above and duty cycle is proportional to frequency of the fan rotation signal (e.g., each falling edge of encoder output). One fixed on time pulse can be generated on each falling edge of the fan rotation signal (e.g., each falling edge of encoder output). This pulse-width modulated (PWM) signal at pin 3 of M1 can then be filtered via filter circuit 320 to provide an analog voltage with minimal ripple. At this point, the signal could be fed into an ADC to be measured but in order for the circuit to operate standalone, it is instead fed into the non-inverting input pin 3 of dual comparator U37.

The filter circuit can include R949 and R1067 which form filters with C1063 and C1151, respectively. Output from the filter 320 is fed though R950 to non-inverting input pin 3 of U37. The inverting input can be set to a threshold voltage via R951 and R952 corresponding to the threshold above which dryer operation is allowed. Capacitor C1065 provides filtering action for the non-inverting input pin 2 of U37 and resistor R953 provides feedback for the comparator. Resistor R954 and C1067 provide output filtering for the signal OUT from the comparator U37. The output signal OUT of the comparator U37 can be a logic high when the voltage corresponding to the fan speed crosses above this threshold value set by R951 and R952. Hysteresis can be provided via R953 to prevent the output of the comparator U37 from switching multiple times as the signal crosses through this threshold level. This output signal OUT can be routed to a digital input pin to provide feedback regarding the state of the hardware.

FIG. 4 is an example of a temperature circuit 400 to monitor temperature and to generate a temperature control signal 410 to a printer dryer based on the temperature. In this example, a window comparator formed from dual comparator U34 is utilized to provide indication of the dryer temperature being within a valid range. The output of a biased thermistor is received by input (IN), with threshold values set corresponding to the minimum and maximum temperatures for which operation of the dryer is allowed. The maximum threshold can be set by resistors R787 and R786 with some filtering provided by C875. The minimum temperature threshold can be set by resistors R866 and R867 with some filtering provided by C877. Resistors R789 and R790 provide hysteresis feedback for the respective comparators of U34. The input IN is fed to the comparators via resistor R862 and R860.

Setting the threshold values to correspond to values outside of the allowed temperature range of the dryer also allows the circuit to be used to detect significant sensor issues, such as a shorted or opened (e.g. uninstalled) thermistor. Output of the window comparator shown as OUT can be a logic high when the temperature is within a valid range. Hysteresis can be provided to prevent the output of the comparators from switching multiple times as the input signal crosses through either threshold level. This output signal OUT can be routed to a digital input pin to provide feedback regarding the state of this hardware. Additional output filtering can be provided by capacitor C1068 and R787 provides a pull-up for U34.

FIG. 5 is an example of a gating circuit 500 to generate a combined control signal to control a printer dryer from the fan control signal and the temperature control signal of FIG. 2. The output signals from the fan monitoring and temperature circuits described herein can be logically AND'ed together via gate D29 to generate a combined control signal at pin 3 of D29. This signal is then logically AND'ed with any number of active high enable signals used for energizing heating elements in the dryer. In this example, two control gates U38 and U39 are provided which receive firmware signals via inputs marked as (IN). The inputs may be pulled down via resistors R608 and R957. Output from gate D29 may be filtered via C1069 and R956 acts as a pull-up. The combined control signal from D29 pin 3 can be gated with firmware control signals received at inputs IN via gates U34 to provide dryer control signals shown at (OUT). This can prevent firmware control of heating elements until all inputs are within a valid range and can prevent situations where a firmware failure could cause a safety concern. The outputs of U38 can be filtered via resistor R958 and capacitor C1071. The outputs of the driver U39 can be filtered via resistor R959 and capacitor C1072.

An additional safety circuit can be provided to monitor for the presence of a voltage rail—in this example the rail identified as V1 (e.g., 5.1 volts), which supplies the comparators U34 and U37. Dual transistor U75 can be employed to provide such monitoring. Input voltage for V1 (e.g., 5.1 volts) is monitored with respect to a predetermined voltage supply threshold via pin 5 of Q75 via bias resistors R967 and R968, where capacitor C1143 provides filtering. Q75 receives V2 at its emitter and drives resistors R1057 and 1058 along with capacitor C1142 at its collector. Another transistor of Q75 can disable the output of D29 by pulling its output to ground if the V1 rail in this example is lost. This circuit provides an additional interlock for the fan and temperature control signals gated by D29.

Figure 6:
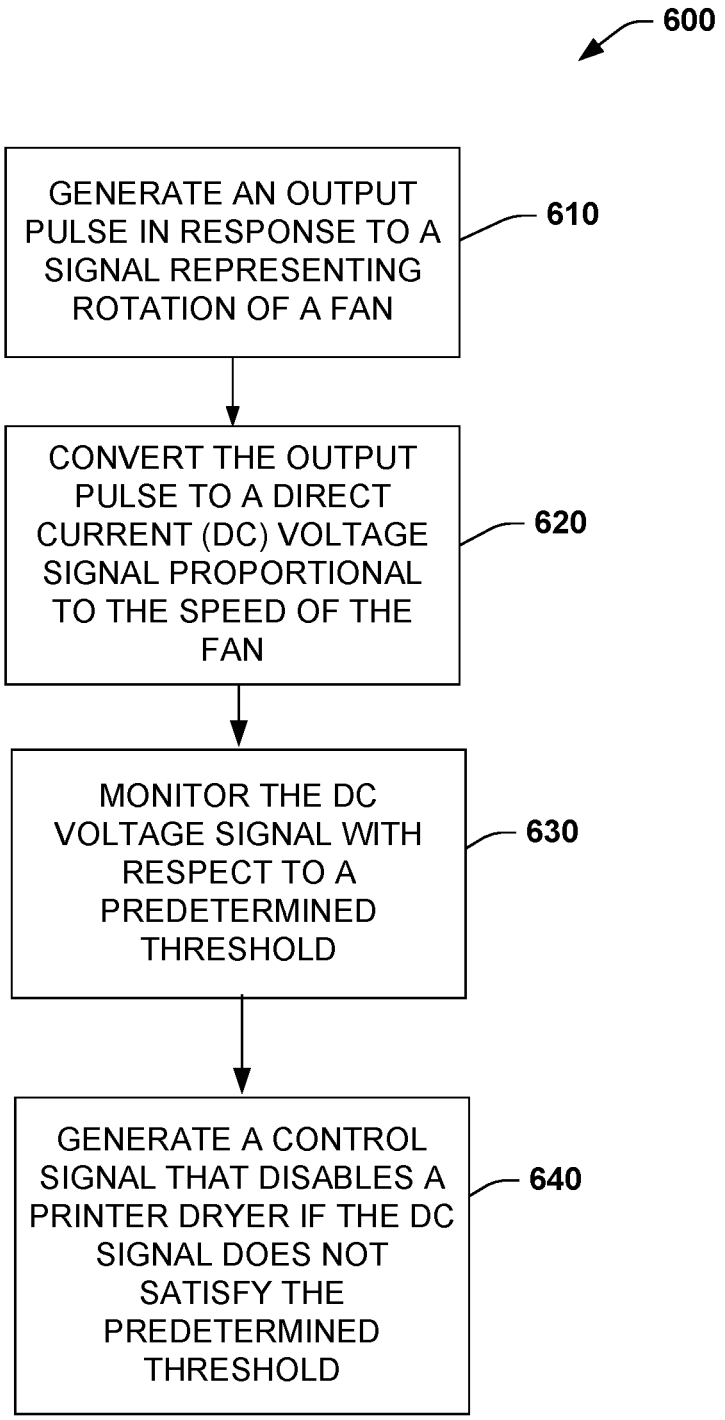
FIG. 6 is a flow diagram illustrating an example method to monitor a fan rotation signal.

In view of the foregoing structural and functional features described above, an example method will be better appreciated with reference to FIG. 6. While, for purposes of simplicity of explanation, the method is shown and described as executing serially, the method is not limited by the illustrated order, as parts of the method could occur in different orders and/or concurrently from that shown and described herein. Such methods can be executed by various components configured in one or more integrated circuits, a processor, or a controller, for example.

FIG. 6 illustrates an example method 600 to monitor a fan rotation signal and to generate a control signal to a printer dryer based on the rotation signal. At 610, the method 600 includes generating an output pulse in response to a signal representing rotation of a fan (e.g., via pulse generator 130 of FIG. 1). A timing relationship between output pulses represents speed of the fan. At 620, the method 600 includes converting the output pulse to a direct current (DC) voltage signal proportional to the speed of the fan (e.g., via filter circuit 140 of FIG. 1). At 630, the method 600 includes monitoring the DC voltage signal with respect to a predetermined threshold (e.g., via monitor circuit 150 of FIG. 1). At 640, the method 600 includes generating a control signal that disables a printer dryer if the DC signal does not satisfy the predetermined threshold (e.g., via monitor circuit 150 of FIG. 1). The method 600 can also include generating the output pulse in response to a rising or falling edge of the signal representing rotation of the fan, the output pulse having a fixed on-time parameter and a variable off-time parameter that varies with the speed of the fan.

What have been described above are examples. One of ordinary skill in the art will recognize that many further combinations and permutations are possible. Accordingly, this disclosure is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. A circuit, comprising:

a pulse generator to generate an output pulse in response to a signal representing rotation of a fan, a timing relationship between output pulses representing speed of the fan;

a filter circuit to convert the output pulse to a direct current (DC) voltage signal proportional to the speed of the fan; and a monitor circuit to monitor the DC voltage signal with respect to a predetermined threshold and to generate control signal that disables a printer dryer if the DC signal does not satisfy the predetermined threshold.

2. The circuit of claim 1, wherein the signal representing rotation speed of the fan is an encoder signal representing the rotation of the fan.

3. The circuit of claim 1, wherein the output pulse has a duty cycle that represents the speed of the fan.

4. The circuit of claim 3, wherein the output pulse has a fixed on-time parameter that is provided by the pulse generator in response to a rising or falling edge of the signal representing rotation of the fan and a variable off-time parameter that varies with the speed of the fan.

5. The circuit of claim 1, wherein the pulse generator includes a comparator to compare the signal representing rotation of the fan with a predetermined signal threshold and to generate an output based on the comparison.

6. The circuit of claim 5, wherein the output from the comparator triggers a monostable circuit to generate a single pulse having a fixed on time and a variable off time, the variable off time representing the speed of the fan.

7. The circuit of claim 1, wherein the monitor circuit further comprises a comparator to monitor the DC voltage signal proportional to fan speed with respect to the predetermined threshold and to generate the control signal if the DC voltage signal satisfies the predetermined threshold.

8. The circuit of claim 7, further comprising a temperature circuit to monitor temperature with respect to a predetermined temperature threshold and to generate a temperature control signal if the temperature satisfies the predetermined temperature threshold.

9. The circuit of claim 8, wherein the control signal and the temperature control signal are gated to generate a combined control signal to disable the dryer if the predetermined threshold and the predetermined current threshold are not satisfied.

10. The circuit of claim 9, further comprising a DC monitor circuit to disable the control signal if a power supply to the comparator does not satisfy a predetermined supply voltage threshold.

11. An circuit, comprising:

a pulse generator to generate an output pulse in response to a signal representing rotation of a fan, a timing relationship between output pulses representing speed of the fan;

a filter circuit to convert the output pulse to a direct current (DC) voltage signal proportional to the speed of the fan;

a monitor circuit to monitor the DC voltage signal with respect to a predetermined speed threshold and to generate fan speed control signal that disables a printer dryer if the DC signal does not satisfy the predetermined speed threshold; and a temperature circuit to monitor temperature with respect to a predetermined temperature threshold and to generate a temperature control signal if the temperature satisfies the predetermined temperature threshold, wherein the fan speed control signal and the temperature control signal are gated to generate a combined control signal to disable the dryer if either of the predetermined thresholds is not satisfied.

12. The circuit of claim 11, wherein the output pulse has a duty cycle that represents the speed of the fan.

13. The circuit of claim 12, wherein the output pulse has a fixed on-time parameter that is provided by the pulse generator in response to a rising or falling edge of the signal representing rotation of the fan and a variable off-time parameter that varies with the speed of the fan.

14. A method, comprising:

generating an output pulse in response to a signal representing rotation of a fan, a timing relationship between output pulses representing speed of the fan;

converting the output pulse to a direct current (DC) voltage signal proportional to the speed of the fan; and monitoring the DC voltage signal with respect to a predetermined threshold; and generating a control signal to disable a printer dryer if the DC signal does not satisfy the predetermined threshold.

15. The method of claim 14, wherein generating the output pulse further comprises generating the output pulse in response to a rising or falling edge of the signal representing rotation of the fan, the output pulse having a fixed on-time parameter and a variable off-time parameter that varies with the speed of the fan.

* * * * *